US006959999B2

(12) United States Patent
Lee

(10) Patent No.: US 6,959,999 B2
(45) Date of Patent: Nov. 1, 2005

(54) FLASHLIGHT HAVING MANUAL CHARGING DEVICE

(76) Inventor: Wen Sung Lee, P.O.Box 63-298, Taichung (TW) 406

( * ) Notice: Subject to any disclaimer, the term of this patent is extended or adjusted under 35 U.S.C. 154(b) by 48 days.

(21) Appl. No.: 10/720,604

(22) Filed: Nov. 20, 2003

(65) Prior Publication Data

US 2005/0111218 A1 May 26, 2005

(51) Int. Cl.[7] ..... F21L 13/04

(52) U.S. Cl. ..... 362/192; 362/183; 362/202; 362/208

(58) Field of Search ..... 362/20, 192, 183, 362/200–208

(56) References Cited

U.S. PATENT DOCUMENTS 1,479,592 A * 1/1924 Evans ..... 362/192
4,360,860 A * 11/1982 Johnson et al. ..... 362/192
4,605,994 A * 8/1986 Krieg ..... 362/202
4,701,835 A * 10/1987 Campagnuolo et al. ..... 362/192
4,907,474 A * 3/1990 Bolger ..... 475/14
6,168,288 B1 1/2001 St. Claire ..... 362/184
6,472,846 B1 * 10/2002 Hutchinson et al. ..... 320/114

FOREIGN PATENT DOCUMENTS

JP 62035162 A * 2/1987 ..... F16H 55/18
JP 2001343047 A * 12/2001 ..... F16F 15/30

* cited by examiner

*Primary Examiner*—Stephen Husar
*Assistant Examiner*—Hargobind S. Sawhney
(74) *Attorney, Agent, or Firm*—Charles E. Baxley

(57) ABSTRACT

A flashlight includes a circuit board received in a housing and having one or more light devices received in a front opening of the housing. One or more chargeable batteries are received in the housing and coupled to the light device for energizing the light device. An actuating device includes a follower rotatably attached to the housing, and a handle pivotally attached to the follower. A gearing device includes a gear coupled to actuate an electric generating device, to generate electric energy to energize the light device. A weight may be secured to the gear of the gearing device, to increase the moment of inertia of the gear, and to facilitate the rotational movement of the gear relative to the housing.

1 Claim, 8 Drawing Sheets

FLASHLIGHT HAVING MANUAL CHARGING DEVICE

BACKGROUND OF THE INVENTION

1. Field of the Invention

The present invention relates to a flashlight, and more particularly to a flashlight having a manually operatable device to generate electric energy to energize the flashlight and/or to charge batteries of the flashlight.

2. Description of the Prior Art

Typical flashlights comprise one or more batteries received in a housing, and coupled to one or more light bulbs, to energize the light bulbs, and to generate lights, such as flashlights.

For example, U.S. Pat. No. 6,168,288 to Claire discloses one of the typical flashlights which also comprise one or more batteries coupled to one or more light bulbs to energize the light bulbs to generate lights.

Most of the batteries are not chargeable, and should be discarded away after the electric energy of the batteries have been consumed. The other batteries may be re-chargeable, and may thus be used again and again.

However, the typical re-chargeable batteries are normally required to be disengaged from the flashlights, and then engaged into a charging sets, for allowing the flashlights to be charged by various electric power sources, such as the electric power sources of house families, of vehicles, of airplanes, etc.

It may take time to disengaged the batteries from the flashlights, and then engaged the batteries into the charging sets to charge the flashlights, and then engaged the batteries into the flashlights again. It may also take a long time, such as thirty minutes or longer, to charge the batteries with the charging sets. The batteries may not be charged and used right away.

In addition, in outdoors, there will be no electric power sources available, such that the batteries may not be charged outdoors, and such that the flashlights may not be used outdoors when the electric energy of the batteries have been consumed.

The present invention has arisen to mitigate and/or obviate the afore-described disadvantages of the conventional flashlights.

SUMMARY OF THE INVENTION

The primary objective of the present invention is to provide a flashlight including a manually operatable device to generate electric energy to energize the flashlight and/or to charge batteries.

The other objective of the present invention is to provide a flashlight including one or more batteries chargeable with the manually operatable device without being disengaged from the flashlight.

The further objective of the present invention is to provide a flashlight including one or more batteries chargeable without electric power sources, for allowing the flashlights to be used outdoors.

The still further objective of the present invention is to provide a flashlight including a reflective member to reflect and/concentrate the lights generated by the flashlight.

The still further objective of the present invention is to provide a flashlight including a water sealing structure to prevent the flashlight from being damaged by humidity or water.

In accordance with one aspect of the invention, there is provided a flashlight comprising a housing including a front opening formed therein, a circuit board received in the housing, and including at least one light device attached thereto and received in the opening of the housing, for being energized to generate light out of the housing, at least one chargeable battery received in the housing and coupled to the light device, for energizing the light device, an electric generating device received in the housing, an actuating device including a follower rotatably attached to the housing, and including a handle pivotally attached to the follower for rotating the follower relative to the housing, and a gearing device received in the housing and coupled between the follower of the actuating device and the electric generating device, to allow the electric generating device to be actuated by the actuating device via the gearing device, and to generate electric energy to energize the light device.

The electric generating device includes a spindle having a pinion attached thereto, the gearing device includes a first gear rotatably received in the housing and engaged with the pinion of the spindle, for driving the pinion of the spindle.

The first gear of the gearing device includes a weight attached thereto, to increase a moment of inertia of the first gear. The first gear of the gearing device includes at least one recess formed therein to receive the weight. The gearing device includes a second gear attached to the follower, and at least one gear and pinion coupled between the first gear and the second gear of the gearing device.

The actuating device includes a knob rotatably attached to the handle, to allow the handle to be rotated relative to the housing. The housing includes a reflector disposed therein and having at least one hole formed therein to receive the light device.

The housing includes a plate disposed therein and having a cavity formed therein and defined by a casing, to receive the electric generating device. The housing includes a base having a peripheral groove formed therein, and a cover having a peripheral rib extended therefrom and engaged into the peripheral groove of the base.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
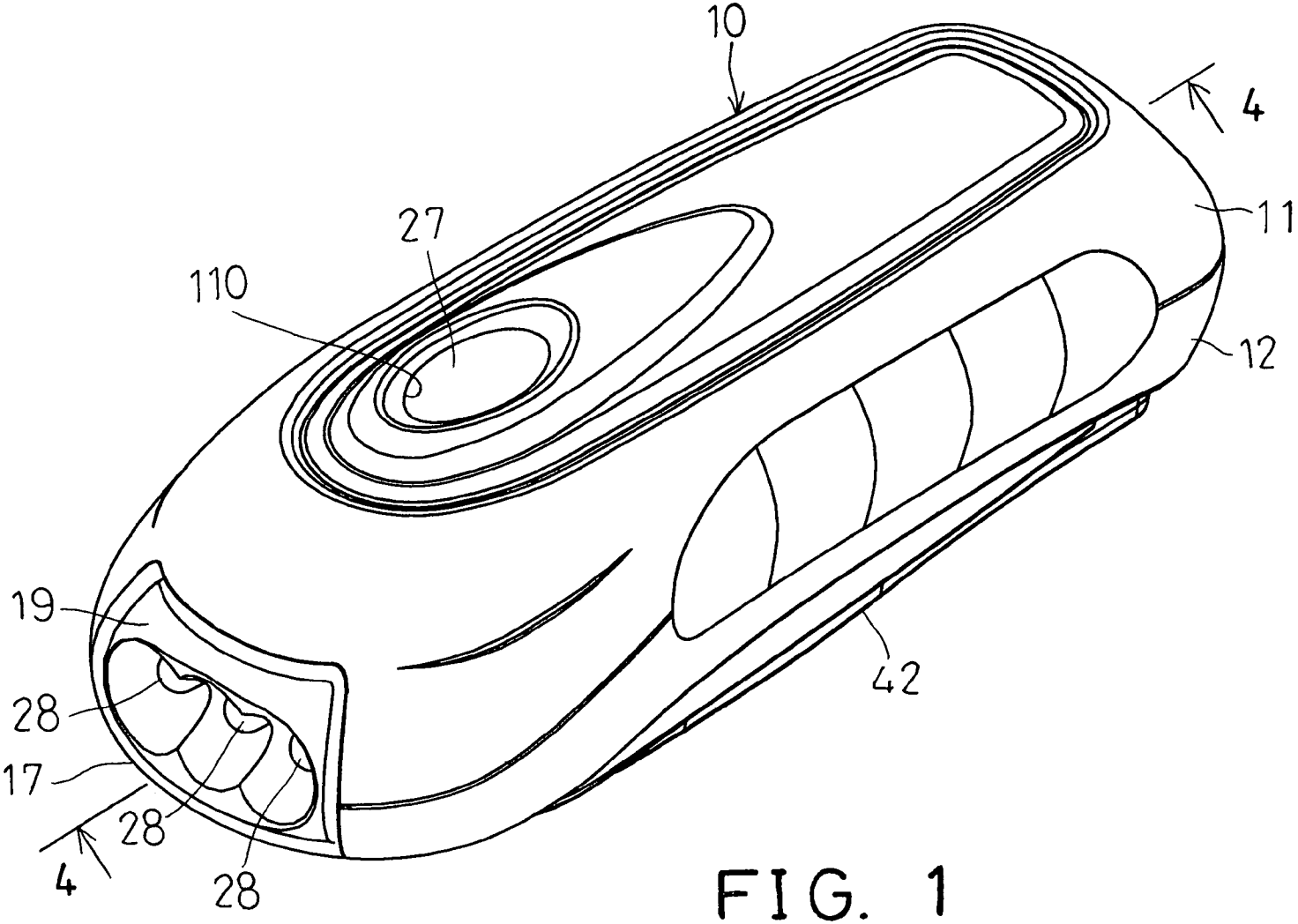
FIG. 1 is an upper perspective view of a flashlight in accordance with the present invention.
Figure 2:
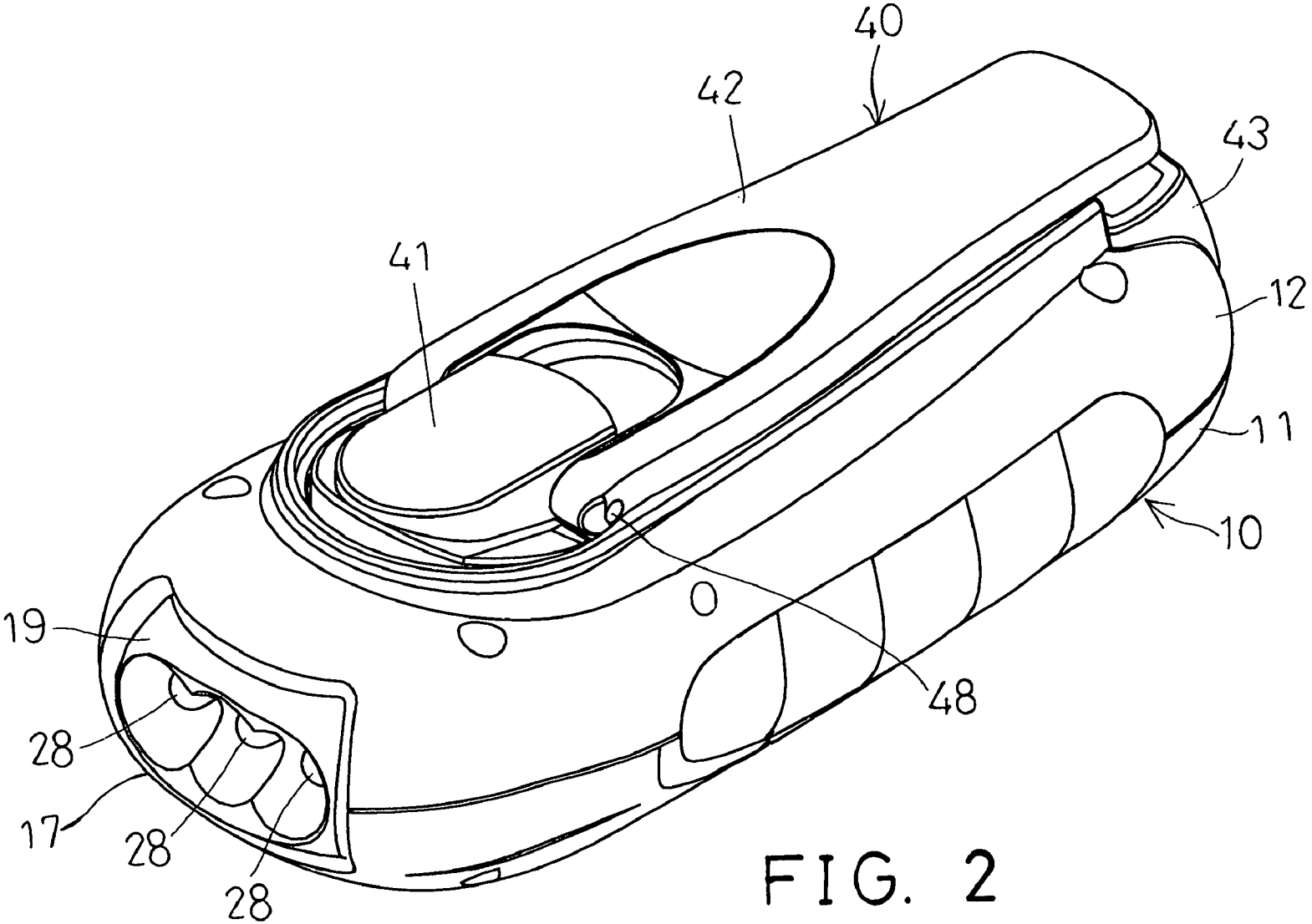
FIG. 2 is a bottom perspective view of the flashlight.
Figure 3:
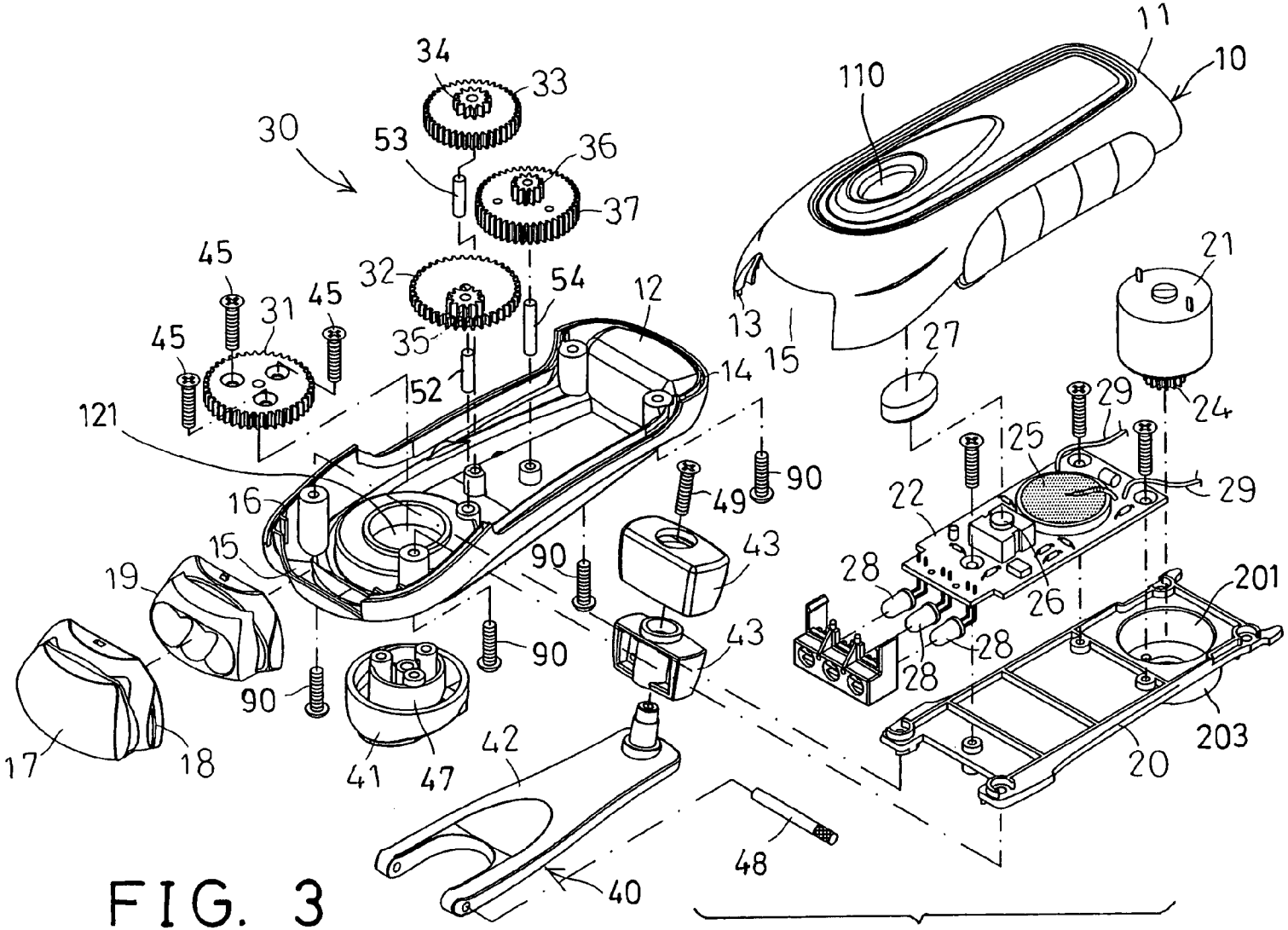
FIG. 3 is an exploded view of the flashlight.

Referring to the drawings, and initially to FIGS. 1–4, a flashlight in accordance with the present invention comprises a housing 10 including such as a cover 11 attached or secured on top of a base 12 with such as fasteners 90. The cover 11 includes a peripheral rib 13 extended downwardly from the bottom peripheral portion thereof (FIGS. 3, 4) for engaging into a peripheral groove 14 of the base 12, for making a water tight seal between the cover 11 and the base 12.

Figure 4:
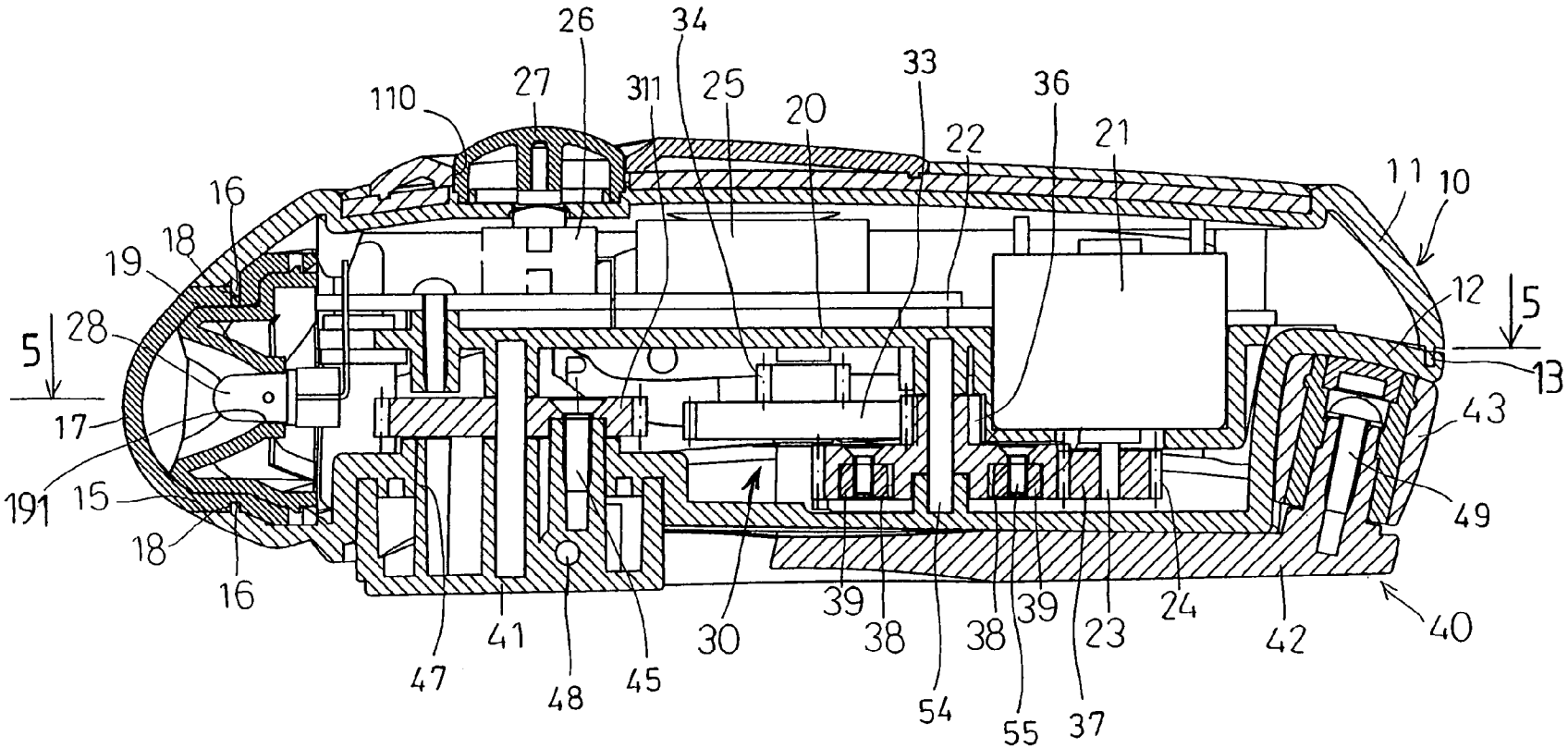
FIG. 4 is a cross sectional view taken along lines 4—4 of FIG. 1.
Figure 5:
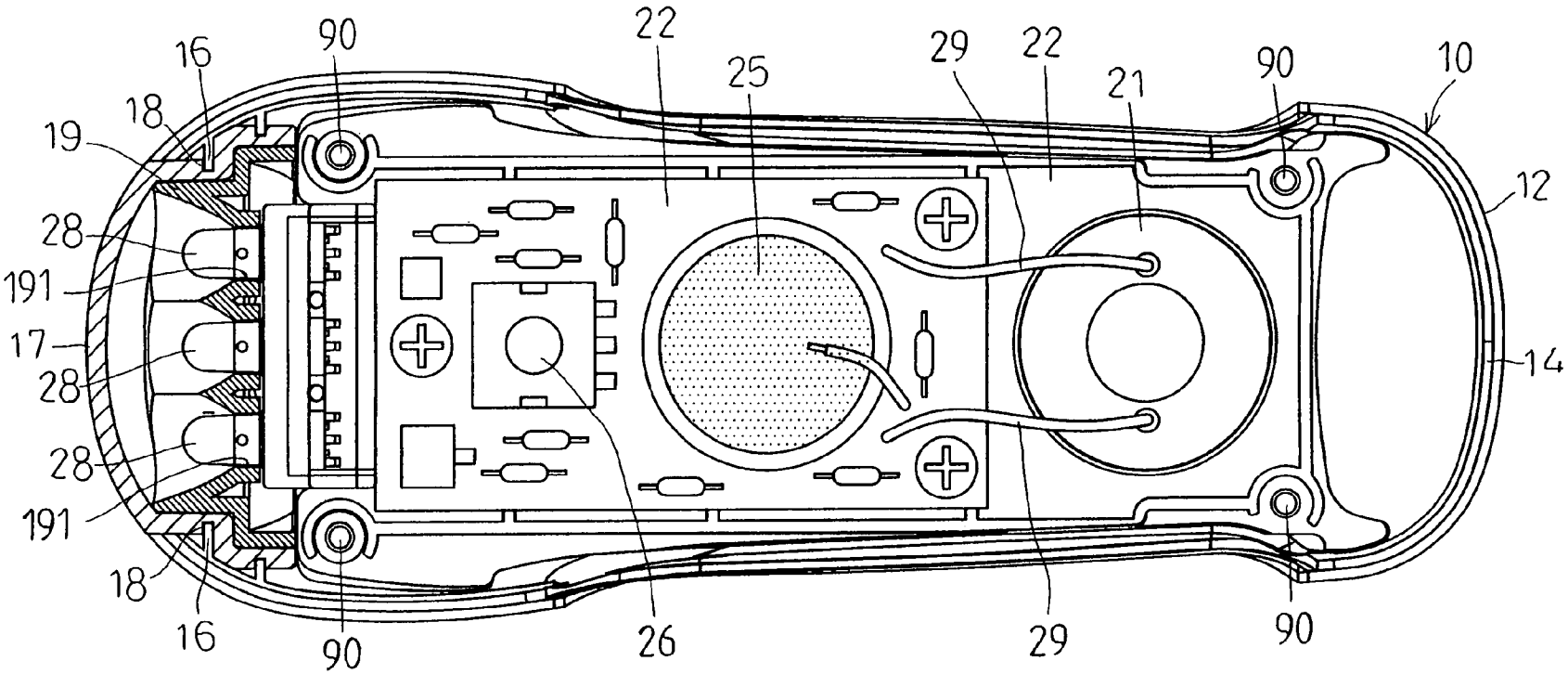
FIG. 5 is a cross sectional view taken along lines 5—5 of FIG. 4.
Figure 6:
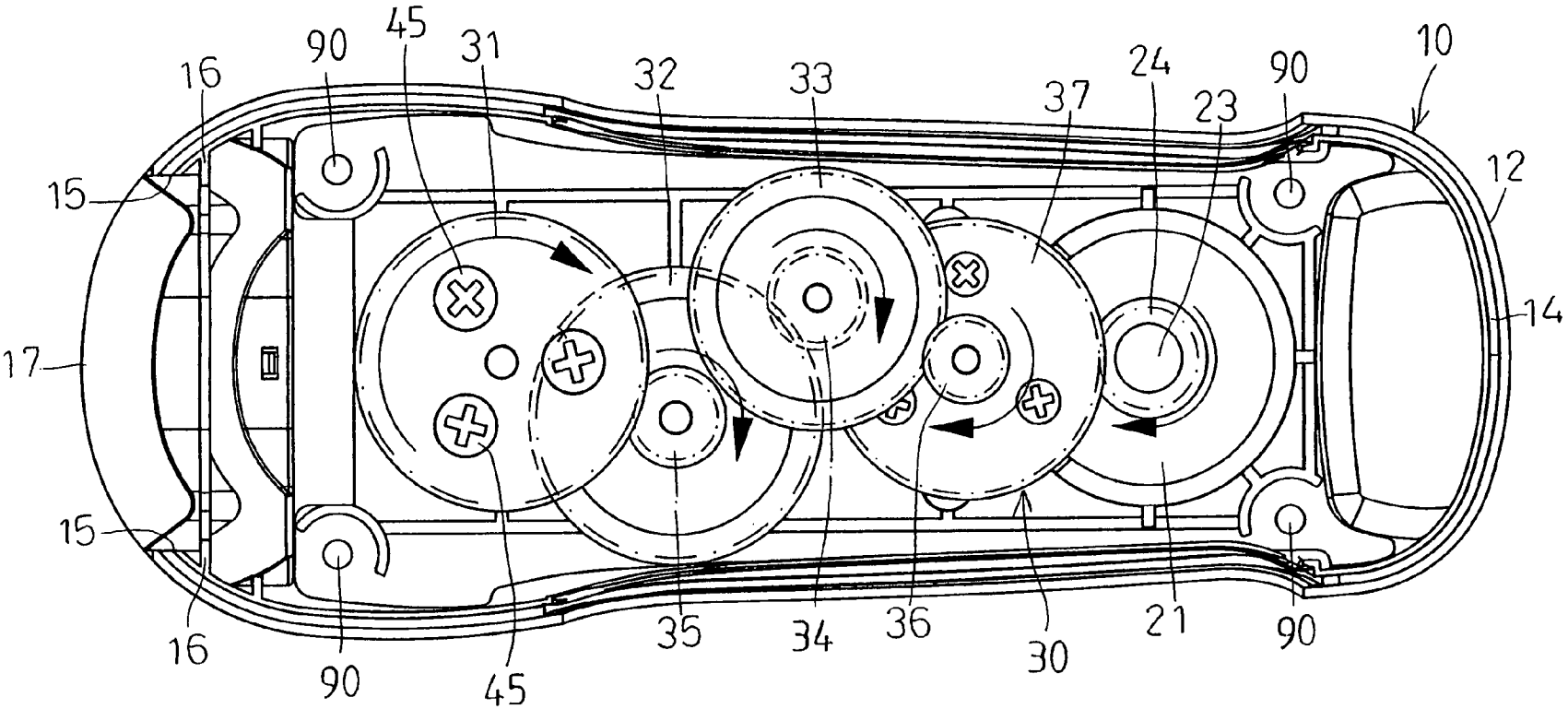
FIG. 6 is a plan schematic view illustrating a coupling or an engagement of gears and pinions.

The housing 10 includes a front opening 15 formed therein, to receive a lens or transparent hood 17 therein, and includes one or more flaps 16 extended therein to engage into the corresponding depressions 18 of the hood 17, and to stably secure the hood 17 in the front opening 15 of the housing 10. A reflective member 19 is received in the front portion of the housing 10, and/or engaged in the hood 17, and includes one or more holes 191 formed therein (FIGS. 4, 5).

A plate 20 is secured in the housing 10, such as secured between the base 12 and the cover 11 with the fasteners 90, and includes a cavity 201 formed therein and defined by a casing 203, to receive a hand pump or electric generator or electric generating device 21 therein. The electric generating device 21 includes a rotor or a spindle 23 extended outward therefrom, and a pinion 24 secured to the spindle 23, so as to be rotated or driven by the electric generating device 21.

A circuit board 22 is supported or secured on top of the plate 20, and one or more chargeable batteries 25, such as lithium or lithium-chloride batteries 25, are disposed on the circuit board 22, and one or more switches 26 are attached to the circuit board 22 for controlling purposes. A button 27 is slidably received in an opening 110 of the cover 11 of the housing 10, and coupled to the switch 26, for actuating or operating or depressing the switch 26.

One or more light devices 28, such as light bulbs, light emitting diodes, etc., are attached to the circuit board 22, and coupled to the batteries 25 and/or the switch 26, for being switched or controlled by the switch 26. The light devices 28 are engaged through the holes 191 of the reflective member 19, to generate lights that may be reflected and/or concentrated by the reflective member 19. The light devices 28 and/or the batteries 25 and/or the switch 26 may preferably be coupled to the electric generating device 21 by such as electric wires 29.

Figure 7:
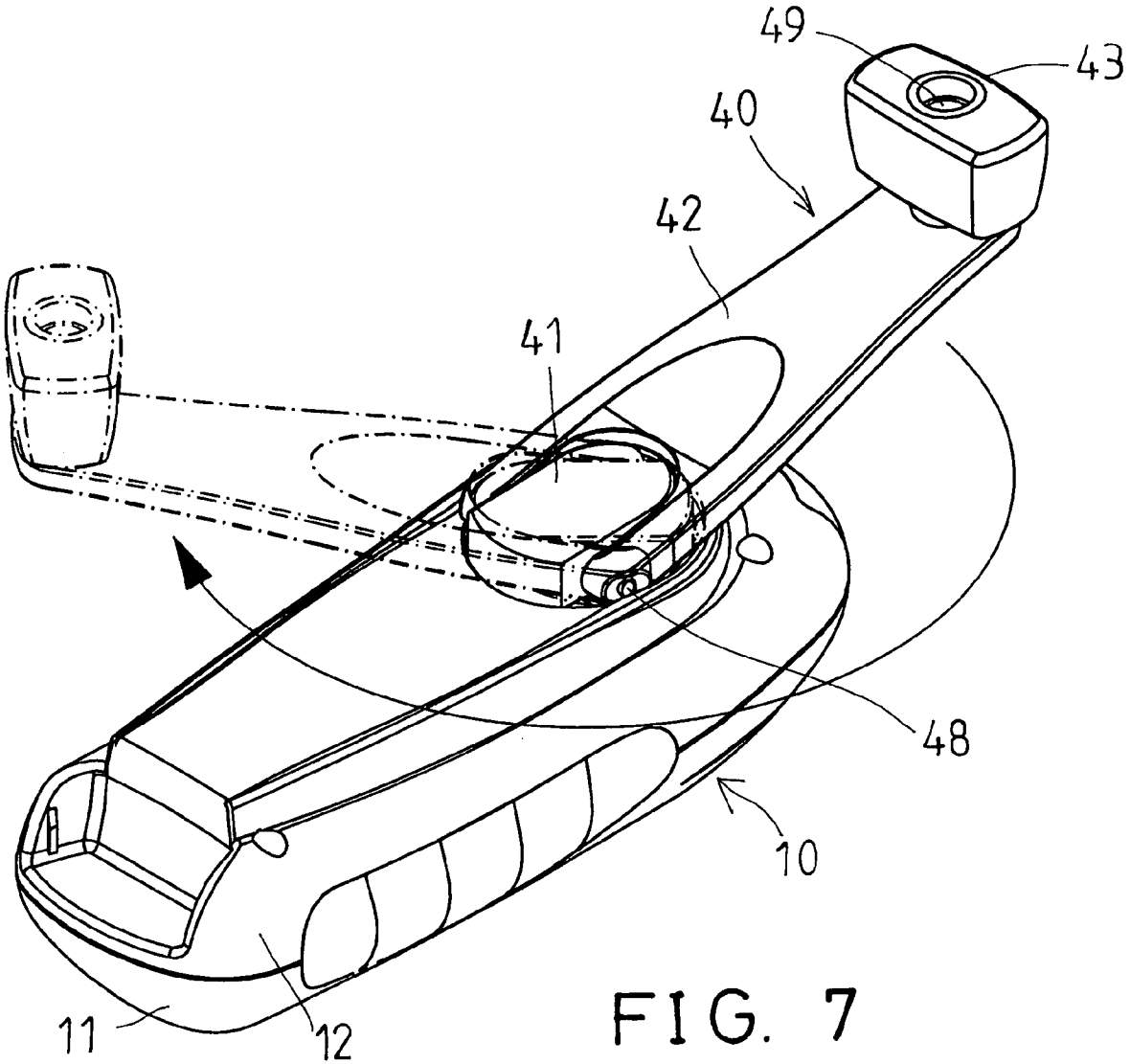
FIG. 7 is a perspective view illustrating the operation of the flashlight.
Figure 8:
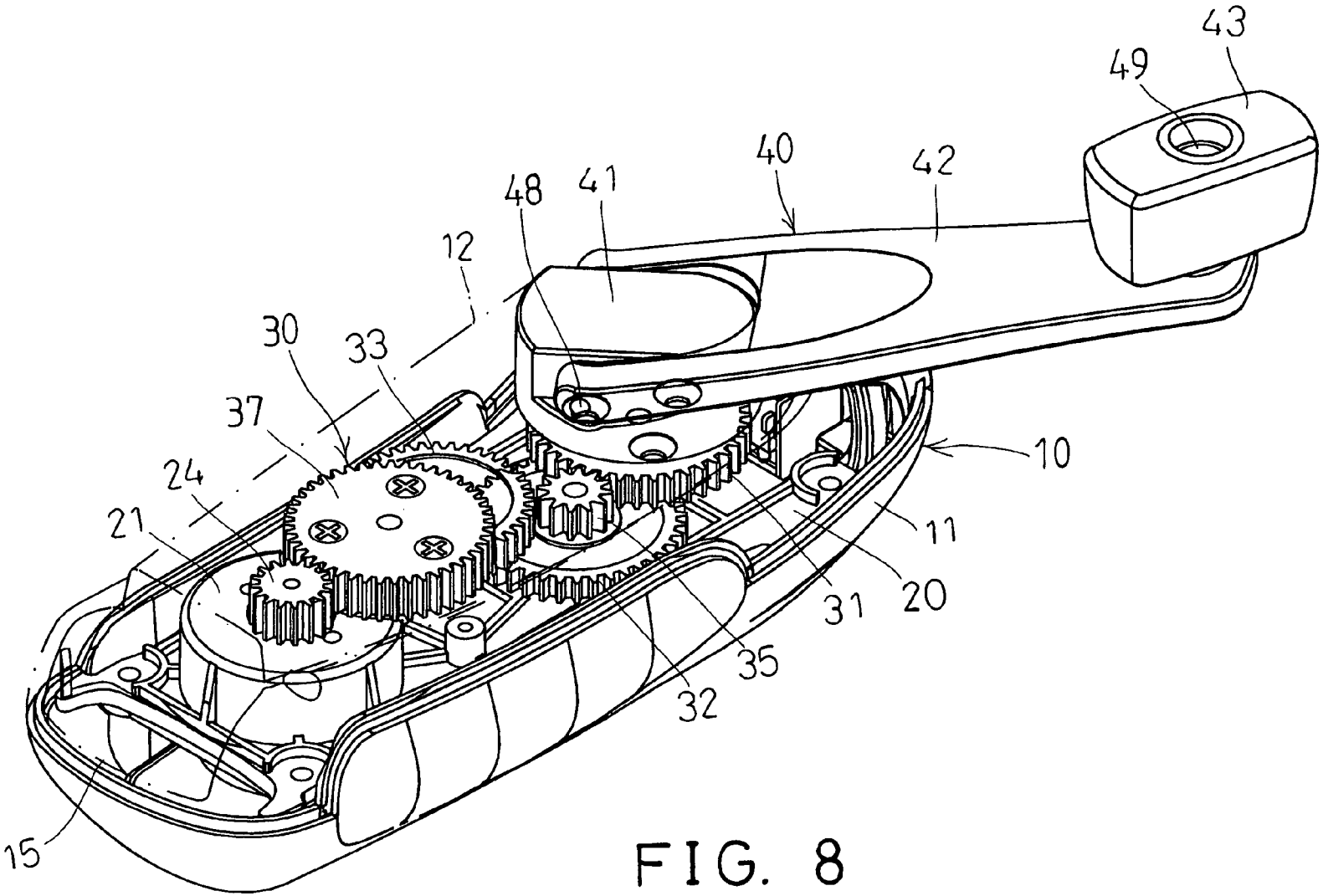
FIG. 8 is a perspective view similar to FIG. 7, in which a portion of the housing has been removed to show an inner structure of the flashlight.

An actuating device 40 includes a follower 41 having a conduit 47 rotatably received in an orifice 121 of the base 12 of the housing 10 (FIG. 3), and includes a handle 42 having one end pivotally secured to the follower 41 with a shaft 48, for allowing the handle 42 to be rotated relative to the follower 41 and the housing 10 between a folded or storing position (FIGS. 1, 2, 4) and an open or working position (FIGS. 7, 8).

A knob 43 may be rotatably secured to the other end of the handle 42 with a fastener 49, to allow the follower 41 to be rotated relative to the housing 10 with the handle 42 by holding the knob 43, best shown in FIGS. 7 and 8. A gearing device 30 is further provided and coupled between the actuating device 40 and the electric generating device 21, for allowing the electric generating device 21 to be actuated or operated by the actuating device 40 via the gearing device 30.

As shown in FIGS. 3, 4, 6, 8, the gearing device 30 includes a gear 31 secured to follower 41 with one or more fasteners 45 and rotated in concert with the follower 41. Another gear 32 is rotatably secured to the base 12 of the housing 10 with a pin 52, and includes a pinion 35 engaged with the gear 31. A further gear 34 is rotatably secured to the base 12 of the housing 10 with another pin 53, and includes a pinion 34 engaged with the gear 32.

A still further gear 37 is rotatably secured to the base 12 of the housing 10 with a further pin 54, and includes a pinion 36 engaged with the gear 33. The gear 37 is engaged with the pinion 24 of the electric generating device 21, such that the pinion 24 of the electric generating device 21 to be actuated or operated or rotated by the handle 42 of the actuating device 40 via the gears 31, 32, 33, 37 and the pinions 35, 34, 36 of the gearing device 30.

As shown in FIG. 4, the gear 37 includes one or more, such as a peripheral recess 38 formed therein, and one or more, such as a peripheral weight 39 received in the recess 38 of the gear 37 with one or more fasteners 55, for increasing the weight of the gear 37, and/or for increasing the stability or moment of inertia of the gear 37, and thus for allowing the pinion 24 of the electric generating device 21 to be effectively rotated by the gear 37.

In operation, as shown in FIGS. 7 and 8, the pinion 24 of the electric generating device 21 may be rotated or driven by the gearing device 30 and by rotating the handle 42 of the actuating device 40, such that the electric generating device 21 may be actuated to generate electric energy, and to directly energize the light devices 28 or to indirectly energize the light devices 28 via the batteries 25, or to charge the batteries 25. The switch 26 may control or switch on and off the light devices 28.

Due to the engagement of the weight 39 in the recess 38 of the gear 37, the moment of inertia of the gear 37 may be increased, such that the pinion 24 of the electric generating device 21 may be effectively rotated or driven by the gearing device 30 and by rotating the handle 42. For example, when the handle 42 is rotated for about one minute, the electric energy generated by the electric generating device 21 is good enough to energize the light devices 28 for up to forty minutes; or is good enough to charge the batteries 25 and then to energize the light devices 28 for up to forty minutes.

Accordingly, the flashlight in accordance with the present invention includes a manually operatable device to generate electric energy to energize the flashlight and/or to charge batteries, and includes one or more batteries chargeable with the manually operatable device without being disengaged from the flashlight, and includes one or more batteries chargeable without electric power sources, for allowing the flashlights to be used outdoors.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A flashlight comprising:

a housing including a front opening formed therein, and including a plate disposed therein and having a cavity formed therein and defined by a casing, and including a base having a peripheral groove formed therein, a cover having a peripheral rib extended therefrom and engaged into said peripheral groove of said base, a reflector disposed in said housing and including at least one hole formed therein, a circuit board received in said housing, and including at least one light device attached thereto and received in said opening of said housing, and received in said at least one hole of said reflector, for being energized to generate light out of said housing, at least one chargeable battery received in said housing and coupled to said at least one light device, for energizing said at least one light device, an electric generating device received in said cavity of said casing of said housing, and including a spindle having a pinion attached thereto, an actuating device including a follower rotatably attached to said housing, and including a handle pivotally attached to said follower for rotating said follower relative to said housing, and including a knob rotatably attached to said handle, to allow said handle to be rotated relative to said housing, and a gearing device received in said housing and coupled between said follower of said actuating device and said electric generating device, to allow said electric generating device to be actuated by said actuating device via said gearing device, and to generate electric energy to energize said at least one light device, said gearing device including a first gear rotatably received in said housing and engaged with said pinion of said spindle, for driving said pinion of said spindle, a weight attached to said first gear of said gearing device, to increase a moment of inertia of said first gear, said first gear of said gearing device including at least one recess formed therein to receive said weight, and said gearing device including a second gear attached to said follower, and at least one gear and pinion coupled between said first gear and said second gear of said gearing device.

* * * * *